US006165340A

United States Patent [19]

Andrus et al.

[11] Patent Number: 6,165,340

[45] **Date of Patent: *Dec. 26, 2000**

[54] PLATING PERMEABLE CORES

[75] Inventors: Lance L. Andrus, Southboro; Cruz R. Calderon, Foxborough, both of Mass.; Craig R. Davidson, Hampstead, N.H.; Patrizio Vinciarelli, Boston, Mass.

[73] Assignee: VLT Corporation, San Antonio, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/941,219

[22] Filed: Oct. 1, 1997

Related U.S. Application Data

[63] Continuation of application No. 08/708,357, Sep. 4, 1996, abandoned, which is a continuation-in-part of application No. 08/563,230, Nov. 27, 1995, abandoned.

[51] Int. Cl.[7] ..... C25D 5/02

[52] U.S. Cl. ..... 205/118; 205/170

[58] Field of Search ..... 205/291, 118, 205/184, 187; 427/272; 216/22

[56] References Cited

U.S. PATENT DOCUMENTS

| | | | |
|---|---|---|---|
| 838,423 | 12/1906 | Kitsee . | |
| 1,582,683 | 4/1926 | Harmon . | |
| 1,994,767 | 3/1935 | Heintz | 175/359 |
| 2,452,529 | 10/1948 | Snoek | 252/62.5 |
| 2,511,230 | 6/1950 | Wald | 175/359 |
| 2,910,662 | 10/1959 | Rex | 336/200 |
| 2,911,604 | 11/1959 | Krause | 336/90 |
| 2,937,351 | 5/1960 | Craig | 336/200 |

(List continued on next page.)

FOREIGN PATENT DOCUMENTS

| | | | |
|---|---|---|---|
| 0 430 802 A1 | 6/1991 | European Pat. Off. . | |
| 0 532 360 A1 | 3/1993 | European Pat. Off. . | |
| 2 247 795 | 5/1975 | France . | |
| 2 462 762 | 2/1981 | France . | |
| 229109 | 11/1909 | Germany . | |
| 27 23 363 | 11/1978 | Germany . | |
| 3627888 A1 | 2/1988 | Germany . | |
| 349985 | 7/1937 | Italy . | |
| 5-8058713 | 4/1983 | Japan . | |
| 61-139013 | 6/1986 | Japan . | |
| 61-224308 | 10/1986 | Japan . | |
| 62-296407 | 12/1987 | Japan . | |
| 63-18964 | 1/1988 | Japan . | |
| 1-154504 | 6/1989 | Japan . | |
| 3-225809 | 10/1991 | Japan | H01F 41/02 |
| 125076 | 3/1928 | Switzerland . | |
| 656891 | 9/1951 | United Kingdom . | |
| 990418 | 4/1965 | United Kingdom . | |
| WO 91/19305 | 12/1991 | WIPO . | |

OTHER PUBLICATIONS

Japanese Abstract No. JP1154504, Jun. 16, 1989.
Japanese Abstract No. JP58058713, Apr. 7, 1983.
Japanese Abstract No. JP61224308, Oct. 6, 1986.
Narcus, "Metallizing of Plastics", Reinhold Plastics, Applications Series, pp. 14–39, Reinhold Publishing Corp., 1960. Month Not Available.
Crepaz et al., "The Reduction of the External Electromagnetic Field Produced by Reactors and Inductors for Power Electronics", ICEM, 1986, pp. 419–423. Month Not Available.
Miyoshi and Omori, "Reduction of Magnetic Flux Leakage from an Induction Heating Range", IEE Transactions on Industry Applications, vol. 1A–19, No. 4, Jul./Aug. 1983.
Holtje and Hall, "A High–Precision Impedance Comparator", *General Radio Experimenter*, vol. 30, No. 11, Apr. 1956, pp. 1–12.
Maurice et al., "Very–Wide Band Radio–Frequency Transformers", *Wireless Engineer*, Jun. 1947, pp. 168–177.

*Primary Examiner*—Kathryn Gorgos
*Assistant Examiner*—Erica Smith-Hicks
*Attorney, Agent, or Firm*—Fish & Richardson P.C.

[57] ABSTRACT

A shield is applied to a permeable core in a predetermined pattern, where the predetermined pattern covers less than the entire surface area of the permeable core.

38 Claims, 21 Drawing Sheets

U.S. PATENT DOCUMENTS

| | | | |
|---|---|---|---|
| 2,939,096 | 5/1960 | Gordon | 336/84 |
| 3,010,185 | 11/1961 | Hume | 29/155.58 |
| 3,032,729 | 5/1962 | Fluegel | 336/84 |
| 3,063,135 | 11/1962 | Clark | 29/155.57 |
| 3,123,787 | 3/1964 | Shifrin | 336/229 |
| 3,149,296 | 9/1964 | Cox | 336/84 |
| 3,154,840 | 11/1964 | Shahbender | 29/155.5 |
| 3,336,662 | 8/1967 | Howland et al. | 29/602 |
| 3,522,509 | 8/1970 | Hasenbalg | 321/2 |
| 3,675,176 | 7/1972 | Brown | 336/182 |
| 3,827,018 | 7/1974 | Thomas et al. | 336/84 |
| 3,851,287 | 11/1974 | Miller et al. | 336/84 |
| 4,145,591 | 3/1979 | Takeda | 219/10.49 |
| 4,156,862 | 5/1979 | Hansen et al. | 336/73 |
| 4,259,654 | 3/1981 | Persson et al. | 336/84 R |
| 4,415,959 | 11/1983 | Vinciarelli | 363/21 |
| 4,443,303 | 4/1984 | Freeman | 204/15 |
| 4,460,884 | 7/1984 | Post et al. | 336/73 |
| 4,464,544 | 8/1984 | Klein | 179/113 |
| 4,484,171 | 11/1984 | McLoughlin | 336/84 R |
| 4,550,364 | 10/1985 | Shaw | 363/24 |
| 4,556,587 | 12/1985 | Tsiamis et al. | 427/304 |
| 4,582,729 | 4/1986 | Tsiamis et al. | 427/304 |
| 4,586,015 | 4/1986 | Takahara et al. | 336/84 C |
| 4,777,465 | 10/1988 | Meinel | 336/65 |
| 4,877,644 | 10/1989 | Wu et al. | 427/53.1 |
| 4,904,314 | 2/1990 | Ames et al. | 148/113 |
| 4,904,498 | 2/1990 | Wu | 427/53.1 |
| 5,003,260 | 3/1991 | Auchterlonie | 324/207.16 |
| 5,398,400 | 3/1995 | Breen et al. | 29/602.1 |
| 5,546,065 | 8/1996 | Vinciarelli et al. | 336/84 |
| 5,657,150 | 8/1997 | Kallman et al. | 359/275 |
| 5,717,552 | 2/1998 | Varian | 360/125 |

PLATING PERMEABLE CORES

This Application is a continuation of U.S. patent application Ser. No. 08/708,357, filed Sep. 4, 1996, now abandoned, which is a continuation-in-part of U.S. patent application Ser. No. 08/563,230, filed Nov. 27, 1995 now abandoned.

BACKGROUND

This invention relates to plating permeable cores.

Electronic transformers, for example, typically have two windings that surround separate portions of a permeable core. Magnetic flux which links both windings through the core is referred to as mutual flux, and flux which links only one winding is referred to as leakage flux. From a circuit viewpoint, the effects of leakage flux are accounted for by associating an equivalent lumped value of leakage inductance with each winding. An increase in the coupling coefficient translates into a reduction in leakage inductance: as the coupling coefficient approaches unity, the leakage inductance of the winding approaches zero.

Precise control of leakage inductance is important in many applications, including switching power converters. For example, zero-current switching converters may need a controlled amount of transformer leakage inductance to form part of the power train and govern various converter operating parameters. One known zero-current switching converter is shown in Vinciarelli, U.S. Pat. No. 4,415,959, incorporated by reference.

Conductive shields have been used to attenuate and alter the spatial distributions of transformer magnetic fields. For example, Vinciarelli et al., U.S. Pat. No. 5,546,065, issued Aug. 13, 1996, incorporated by reference, describes using a conductive medium to confine and suppress leakage flux.

SUMMARY

In general, in one aspect, the invention features plating a shield to a-permeable core in a predetermined pattern, where the predetermined pattern covers less than the entire surface area of the permeable core.

Implementations of the invention may include one or more of the following features. Plating may include removing a portion of a seed layer to leave a predetermined pattern of seed layer on the permeable core and plating an outer layer on the seed layer. Plating a shield may also include electrolessly depositing the seed layer on the permeable core. Removing a portion of the seed layer may include ablating the portion of the seed layer with a laser. The invention may further include generating, interactively by computer, pattern data defining the portion of the seed layer to be removed, and transferring the pattern data from a computer aided design station to a computer that controls the removal of the portion of the seed layer. The invention may also include identifying a geometric configuration of the permeable core and removing the portion of the seed layer in accordance with the identified geometric configuration.

Plating may also include depositing a seed layer on the permeable core in a predetermined pattern defined by a mask and plating an outer layer on the seed layer. The invention may also feature identifying a geometric configuration of the permeable core and selecting the mask from a supply of masks in accordance with the geometric configuration of the permeable core.

The permeable core may include a permeable core segment, and after plating, the invention may feature attaching an end of the permeable core segment to an end of another permeable core segment to form a permeable core. The invention may also feature adding windings to the plated permeable core and connecting the plated permeable core to a power converter circuit.

In general, in another aspect, the invention features depositing a seed layer on the permeable core, removing, automatically, a portion of the seed layer, and plating an outer layer on the seed layer.

In general, in yet another aspect, the invention features depositing a seed layer on a permeable core in a predetermined pattern defined by a mask, and plating an outer layer on the seed layer.

In general, in yet another aspect, the invention features patterning a shield on a permeable core in a pattern configured to achieve a controlled leakage inductance.

Implementations of the invention may include one or more of the following features. One feature includes depositing a seed layer on a surface of the permeable core before patterning and plating an outer layer on the seed layer before patterning. Patterning may include forming a pattern in a layer of resist on the outer layer and etching a portion of the outer layer and a portion of the seed layer in accordance with the resist pattern. Forming a pattern may include ablating a portion of the resist layer with a laser beam. The invention may also feature identifying a geometric configuration of the permeable core and forming the pattern in the layer of resist in accordance with the identified geometric configuration of the permeable core.

In general, in another aspect, the invention features depositing a seed layer on a permeable core, plating an outer layer on the seed layer, ablating a resist layer on the outer layer with a laser beam to form a predetermined resist pattern on the outer layer, and etching the outer layer and the seed layer in accordance with the resist layer pattern.

In general, in another aspect, the invention features processing permeable cores moving along an automated production line including, for each of the permeable cores, determining a shield pattern to be plated on the permeable core, and plating the determined shield pattern on the permeable core.

In general, in another aspect, the invention features processing permeable cores moving along an automated production line including, for each of the permeable cores, determining a shield pattern for the permeable core, and patterning a plated shield in accordance with the determined shield pattern to achieve a controlled leakage inductance.

In general, in another aspect, the invention features an apparatus including a permeable core having a plated shield. The shield includes a seed layer with a laser cut edge and an outer layer plated to the seed layer.

In general, in another aspect, the invention features an apparatus including a permeable core having a plated shield. The shield includes a seed layer deposited on the permeable core in accordance with a mask, and an outer layer plated to the seed layer.

In general, in another aspect, the invention features an apparatus including a permeable core having a plated shield. The shield includes a seed layer deposited on the permeable core and an outer layer plated to the seed layer, where a portion of the outer layer and a portion of the seed layer are etched away in accordance with a predetermined pattern to achieve a controlled leakage inductance.

In general, in another aspect, the invention features covering a permeable core with a barrier coating and plating a shield to the core in a predetermined pattern.

Implementations of the invention may include one or more of the following features. Before plating the permeable core, the barrier coating may be applied to prevent the plating chemicals from changing the properties of the core. The barrier coating may comprise plastic or Parylene, and may cover only a portion of the surface area of the core. Plating a shield may include rack plating or barrel plating copper in an acid or alkaline bath. A portion of the barrier coating may be removed to expose the surface of the permeable core by ablating with a laser, or grinding, or using air abrasion.

In general, in another aspect, the invention features pad-printing a seed layer on the permeable core. The seed layer may comprise a conductive material, such as silver ink containing no iron, cobalt, or nickel. The seed layer may be printed on only a fraction of the surface area of the permeable core. A shield may be plated on the seed layer.

In general, in another aspect, the invention features coating a permeable core with photodefinable epoxy, curing the epoxy to the core, and plating a shield to the portions of the core not covered with epoxy.

Implementations of the invention may include one or more of the following features. Curing of the photodefinable epoxy may include using an ultraviolet laser or an ultraviolet oven. The invention may also feature washing off the uncured portions of epoxy in an alcohol bath.

In general, in another aspect, the invention features coating a permeable core with photodefinable epoxy, curing the epoxy to the core with an ultraviolet laser, washing off the uncured portions of epoxy in an alcohol bath, further curing the epoxy in an ultraviolet oven, and barrel plating a copper layer on the exposed portion of the core using an alkaline bath.

In general, in another aspect, the invention features coating a permeable core with Parylene, pad-printing a seed layer of iron, cobalt, and nickel-free silver ink on top of the Parylene coating, and rack plating a copper layer on top of the seed layer using an acid bath.

Implementations of the invention may include one or more of the following features. A portion of the shield may be ablated with a laser to expose the surface of the permeable core.

In general, in another aspect, the invention features coating a permeable core with Parylene, ablating a predetermined pattern of the Parylene coating with a laser, and barrel plating a copper layer on top of the exposed portions of the permeable core using an alkaline bath.

In general, in another aspect, the invention features an apparatus including a permeable core, a barrier coating on the core, a seed layer on the barrier coating, and an outer conductive layer on the seed layer.

In general, in another aspect, the invention features an apparatus including a permeable core, a barrier coating on the core, and a conductive layer on the portions of the core not covered by the barrier coating.

Advantages of the invention may include one or more of the following. Plating a shield in a predetermined pattern to a permeable core allows precise control over the location, spatial configuration, and amount of leakage flux. Plating also reduces air gaps between the shield and the core which insures high thermal conductivity and further control over leakage flux. A variety of shield patterns may be provided depending upon the application for the core and the core's geometric configuration. Laser ablation minimizes fixture changes and development time and reduces tooling and inventory costs while allowing cores, including cores with varying geometric configurations, to be plated with various patterns.

Covering a permeable core with a barrier coating before plating a shield with an acid bath protects the core from the corrosive effects of the plating process. In an acid bath, exposed portions of the core tend to react with the acid resulting in a change in the magnetic characteristics of the core. For example, when a ferrite core containing zinc or zinc compounds is exposed to an acid plating bath there is a measurable degradation in the magnetic and core loss characteristics of the ferrite material. Using an acid bath is advantageous because a higher deposition rate is possible than in an alkaline bath. When plating in an alkaline bath, where the danger of corrosion is not present, the use of a barrier coating simplifies the plating process by allowing the shield to be plated directly to the surface of the core. A partial barrier coating may be applied in a predetermined pattern to define the portions of the core that should not be plated.

Pad-printing a seed layer on the permeable core in a predetermined pattern allows precise control of where plating will be deposited on the core. Using a conductive material for the seed layer, such as silver ink, helps minimize losses attributable to the shield.

A barrier coating of photodefinable epoxy allows quick curing to the surface of the permeable core by using an ultraviolet laser. Predetermined laser patterns provide the potential for curing the epoxy to a variety of geometric shapes.

Other advantages and features will become apparent from the following description and from the claims.

DESCRIPTION

FIG. 1*a* is a perspective view of a power converter.

FIG. 1*b* is a schematic diagram of a switching power converter circuit including a transformer.

Figure 1A:
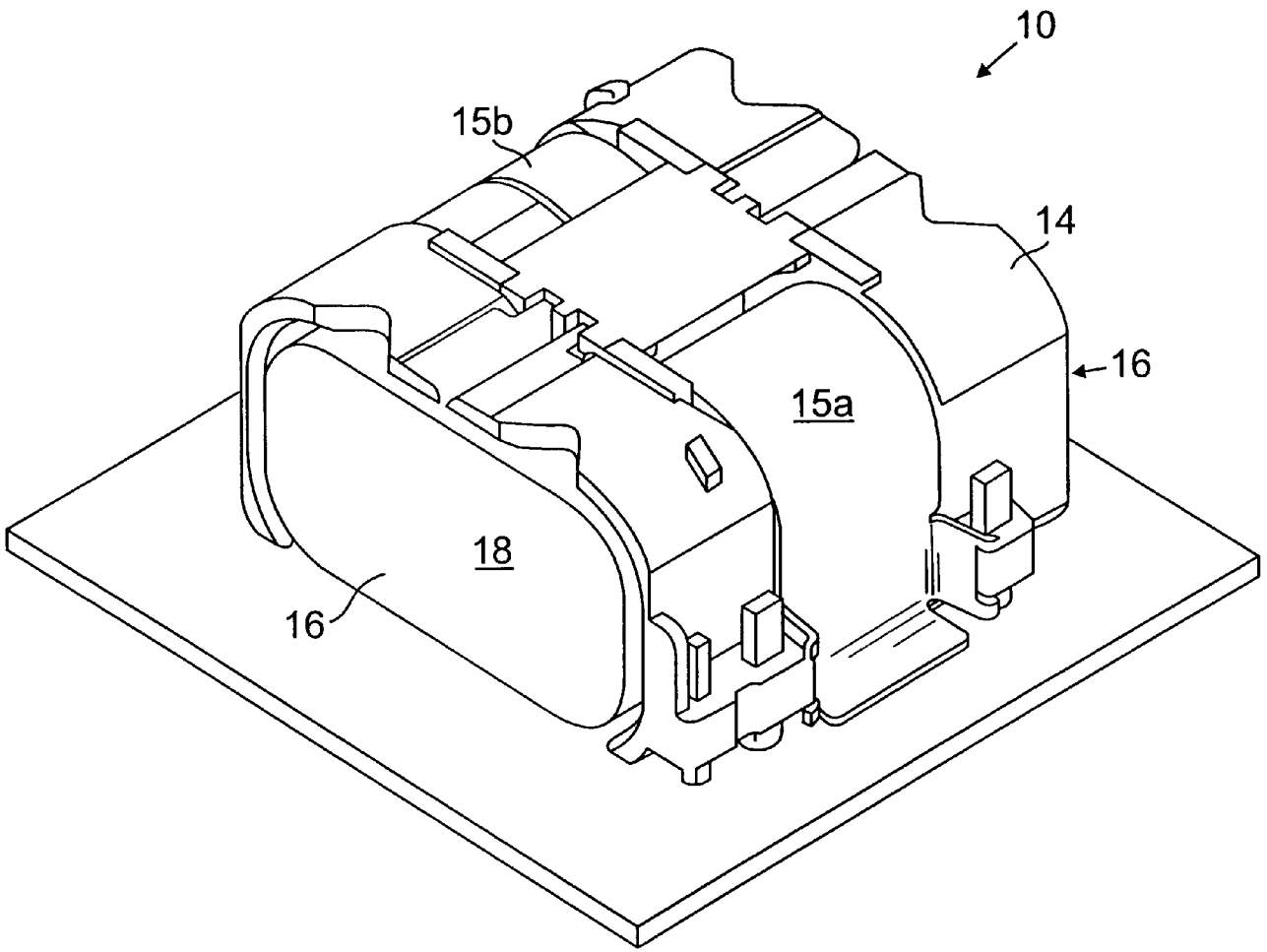
Figure 1B:
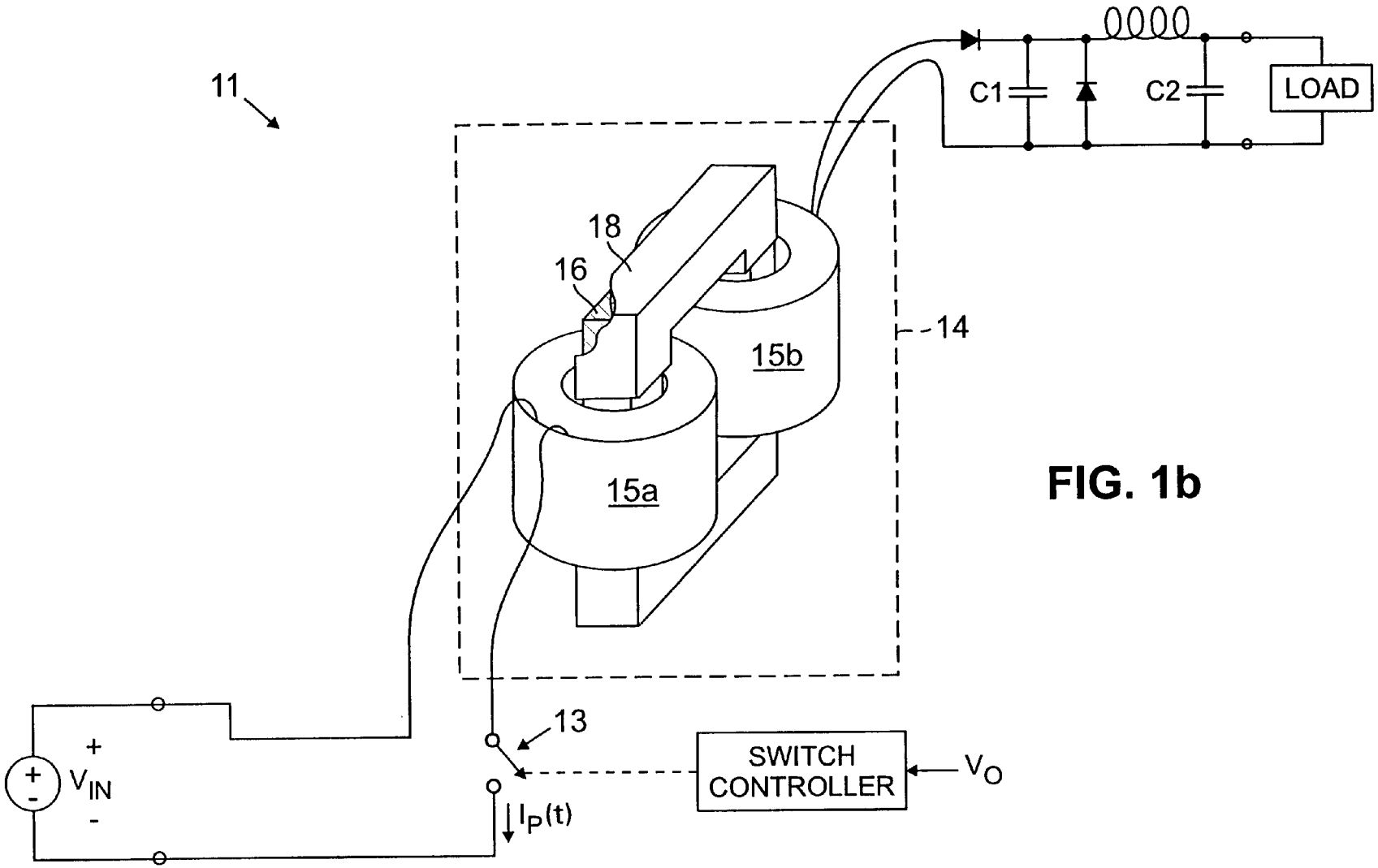
Figure 2:
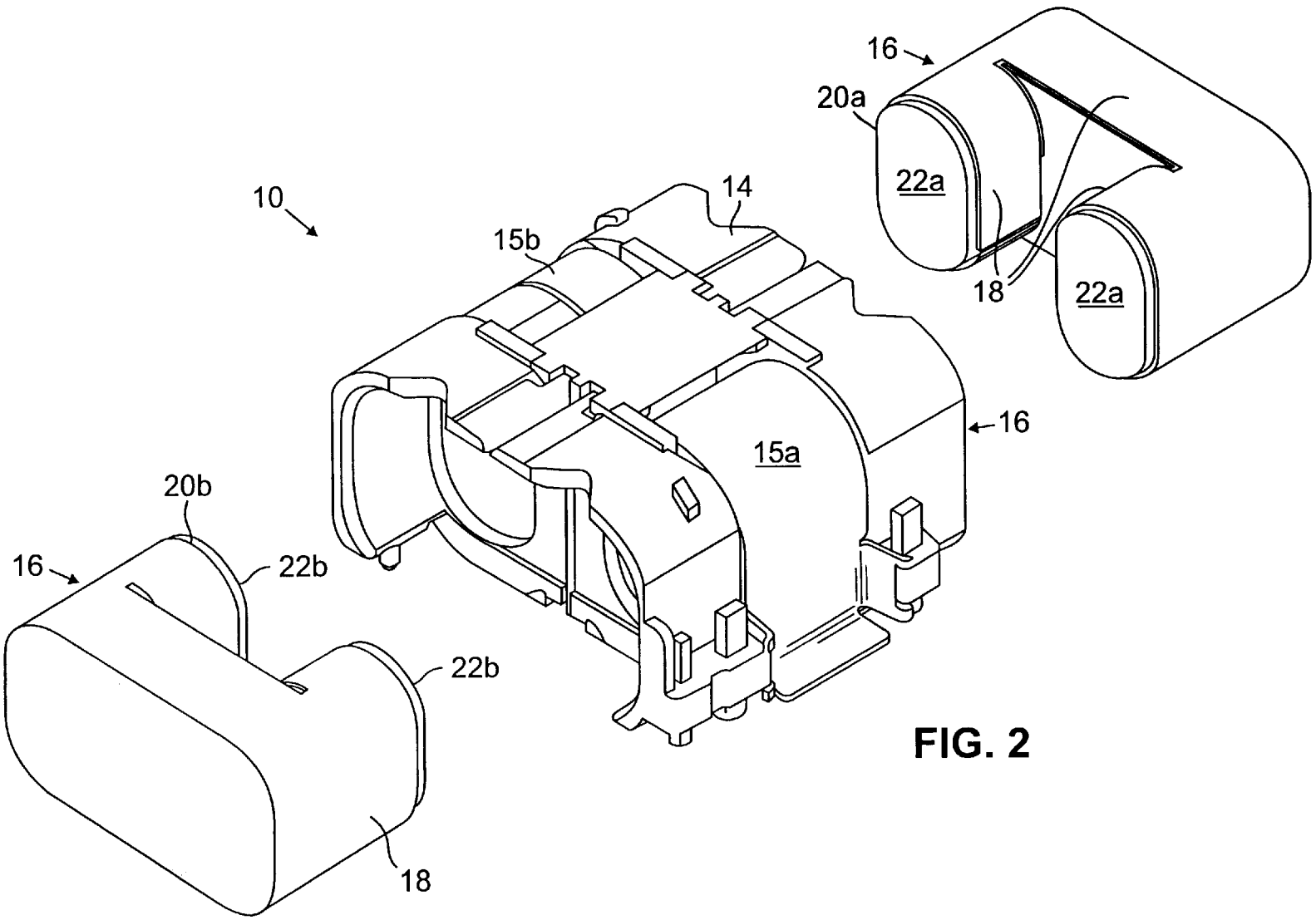
FIG. 2 is a perspective view of a permeable core segment having a plated shield.

Referring to FIG. 1*a*, a power converter 10 includes a switching power converter circuit 11 (FIG. 1*b*) including a transformer 14 having two windings 15*a*, 15*b* and a switch 13. The windings are wound around a permeable core 16, e.g., ferrite, having a plated shield 18, e.g., copper. Referring also to FIG. 2, permeable core 16 contains, for example, two permeable core segments 20*a*, 20*b*. To form core 16, ends 22*a* and 22*b* of segments 20*a* and 20*b*, respectively, are attached together, for example, by gluing, after shield 18 has been plated in a predetermined pattern to segments 20*a* and 20*b*.

Figure 3:
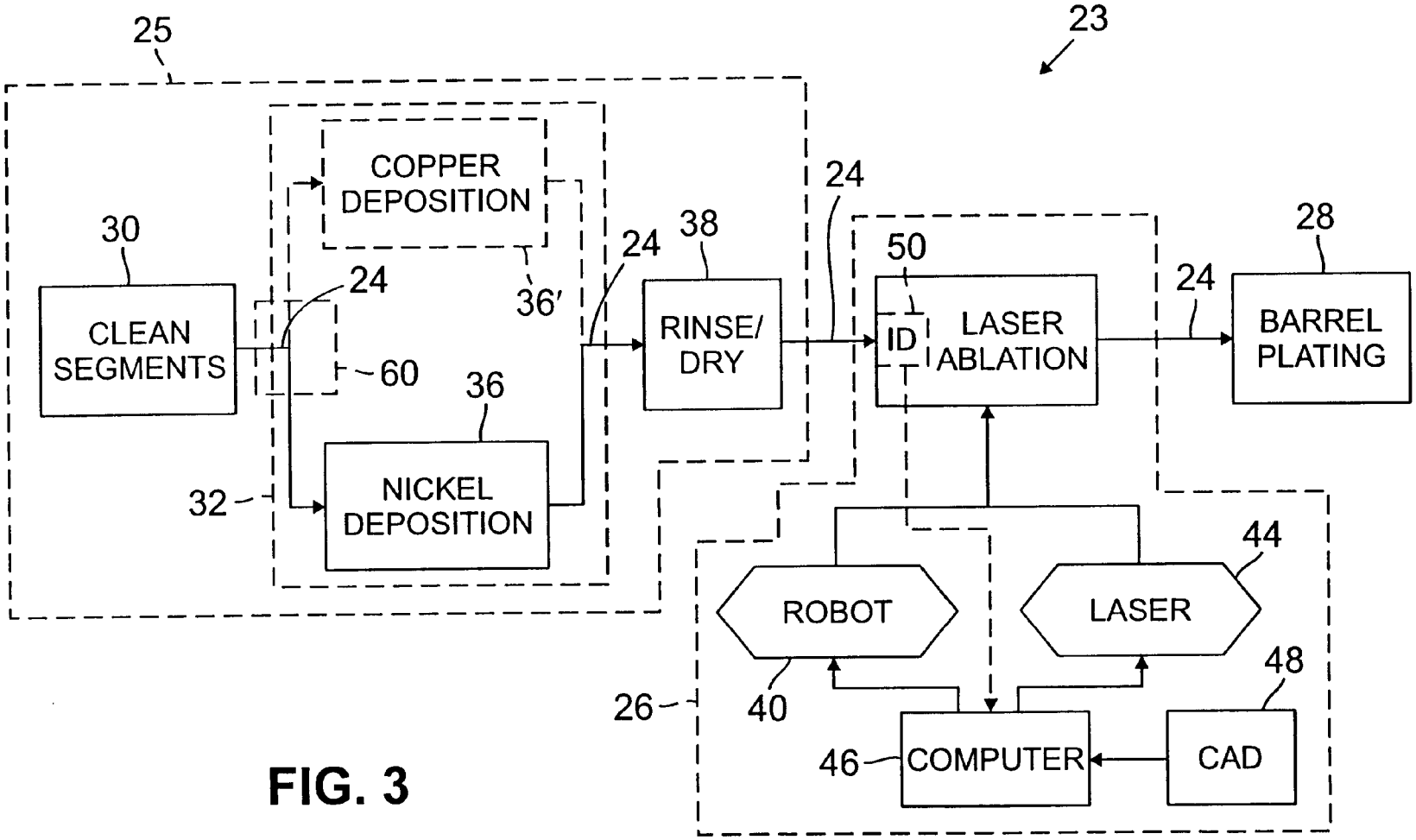
FIG. 3 is a block diagram of a laser ablation manufacturing line.

Referring to FIG. 3, a laser ablation manufacturing line 23 plates shield 18 (FIG. 2) on a series of permeable core segments 20*a*, 20*b* in a predetermined pattern by passing the core segments on a conveyor belt 24 through an electroless deposition station 25, a laser patterning station 26, and an electrolytic plating station 28. Referring also to FIGS. 4–7, within electroless deposition station 25, a core segment 20 (FIG. 4) is cleaned at a cleaning station 30 before being passed through electroless deposition station 32 where a conductive seed layer 34 (FIG. 5) of, for example, nickel 36, is electrolessly (i.e., chemically) deposited on the entire surface of core segment 20. Seed layer 34 is approximately 0.04–0.1 mils (0.001–0.0025 millimeters) thick, T1.

Before being passed through laser patterning station 26, segment 20 including seed layer 34 (i.e., seeded segment 20', FIG. 5) is rinsed and dried at a rinse/dry station 38. Within the laser patterning station, each seeded se pent 20' is grasped by a robotic arm 40. A pattern 42 (FIG. 6) within seed layer 34 is ablated (i.e., removed, patterned) by a laser beam (not shown) generated by a laser unit 44. Robotic arm 40 may be a model V-E2, manufactured by Mitsubishi, Inc.™, and laser unit 44 may be model LME6000 laser system, manufactured by A.B. Laser, Inc™. Pattern 42 exposes ends 22 of segment 20 such that after the shield is plated to the segment, ends 22 remain unplated and may be attached to the ends of another segment to form core 16.

The configuration of pattern 42 is determined by the movement of the seeded segment with respect to the laser beam. Laser unit 44 may hold the laser beam in a fixed position while robotic arm 40 moves seeded segment 20' through the path of the laser beam, or robotic arm 40 may hold seeded segment 20' in a fixed position while laser unit 44 moves the laser beam over the surface of the seeded segment. Similarly, laser unit 44 may move the laser beam while robotic arm 40 simultaneously moves the seeded segment. For example, to ablate portions of a plated nickel layer of nominal 0.1 mil (0.0025 millimeter) thickness off of a ferrite core, a model LME6000 laser, referenced above, may be set for a beam spot size of 3.5 mils (0.0089 millimeters), a Q-switch pulse rate of 15 Khz and a lamp power of 16 Amperes. Ablation is performed at a beam scan rate of 98.4 inches/second (2500 mm/sec).

A CAD station 48 is used to design pattern 42. The pattern design is then converted by CAD station 48 into pattern data for controlling the movement of either or both the robotic arm and the laser beam and for controlling when, during movement, the laser beam is generated (i.e., the laser beam may be pulsed on and off). CAD station 48 sends the pattern data to a computer 46 which controls the movement of either or both the robotic arm and the laser beam and controls when the laser beam is generated according to the pattern data.

Because the movement data is stored in computer 46, seeded segments 20' having different geometric configurations can be patterned one after another on a single manufacturing line 23. When a seeded segment 20' enters laser patterning station 26, an identification (ID) station 50 determines the type of segment configuration and notifies computer 46. Computer 46 then uses pattern data previously received from CAD station 48 and associated with the determined segment configuration type to control the movement of either or both the robotic arm and the laser beam and the generation of the laser beam.

Using CAD station 48, the pattern data may be quickly and easily changed such that new patterns are formed in seed layer 34. As a result, the pattern design is flexible and no tooling changes are required before ablating new patterns. Additionally, assembly time and the number of parts required for manufacturing line 23 are reduced because no fixture changes are required to ablate new patterns in the seed layer.

After pattern 42 is ablated from seed layer 34, seeded segments 20' with patterned seed layers 34 (i.e., patterned seeded segments 20", FIG. 6) are passed through electrolytic plating station 28. In electrolytic plating station 28, a thick (T2, e.g., 4–5 mils) layer 52 (FIG. 7) of, for example, copper is electrolytically plated (using, for example, barrel plating) to patterned seed layer 34. As a result, shield 18, consisting of seed layer 34 and copper layer 52, is plated to permeable core segment 20 in a predetermined pattern.

Other embodiments are within the scope of the following claims.

For example, seed layer 34 (FIG. 5) may be formed from a variety of conductive metals, including, for example, copper 36'.

Instead of including a robotic arm 40 in laser ablation manufacturing line 23, seeded segments 20' may be manually positioned by an operator on a tray (not shown) over which laser unit 44 moves the laser beam to ablate seed layer 34 along one or more sides of the seeded segment not resting on the tray. The operator may then manually reposition the partially patterned seeded segment on the tray such that an unpatterned side of the seeded segment may be patterned by the laser unit.

Between cleaning station 30 and deposition station 32, manufacturing line 23 may include a masking station 60 where surface areas on segments 20 which are commonly unplated, for instance, ends 22, are masked such that seed layers are not deposited on these surface areas. This reduces the amount of seed layer 34 to be ablated by laser patterning station 26.

As an alternative to a two segment permeable core 16, core 16 may be a single solid piece or core 16 may include more than two segments. The shields on each core segment may be identical or different depending upon the final application for core 16. Additionally, the core segments may be glued together before the shields are plated to the segments provided the process for plating the shields on the segments does not reduce the integrity of the bond between the segments.

Figure 8:
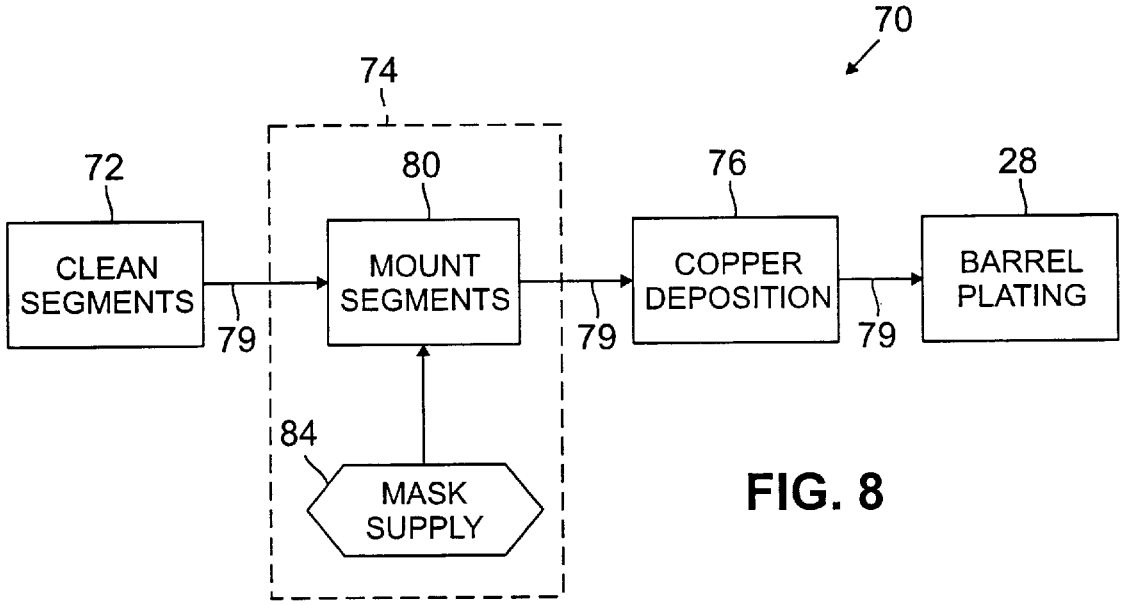
FIG. 8 is a block diagram of a masking manufacturing line.
Figure 9:
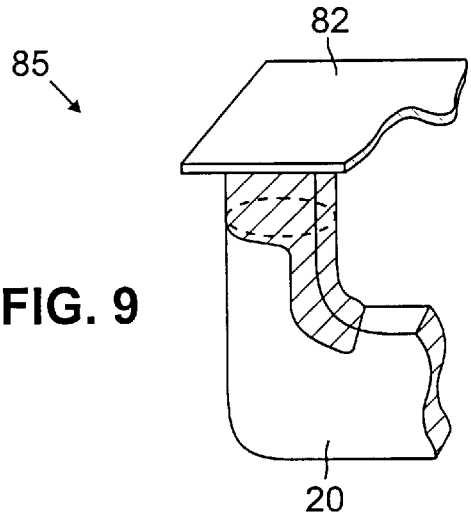
FIG. 9 is a perspective view of a permeable core segment in a masking fixture.

Referring to FIG. 8, an alternative to laser ablation manufacturing line 23 (FIG. 3) is masking manufacturing line 70 which does not require a laser patterning station 26. Similar to laser ablation manufacturing line 23, masking manufacturing line 70 plates shields (18, FIG. 2) on a series of permeable core segments (20, FIG. 4) in a predetermined pattern. Masking manufacturing line 70 includes a cleaning station 72, a masking station 74, an electroless deposition station 76, and an electrolytic plating station 28. After a segment 20 is cleaned in cleaning station 72, a conveyor belt 79 carries the segment to a mounting station 80 within masking station 74 where the segment is mounted (manually or automatically) in a mechanical masking fixture 82 (FIG. 9). Masking fixture 82 is selected from a fixture supply 84 in accordance with the geometric configuration of the segment.

The masking fixture covers portions 86 (FIG. 2) of segment 20 and when the mounted segment 85 and fixture 82 are passed through electroless deposition station 76, a seed layer 34 (FIG. 6) of, for example, copper, is deposited only on the exposed surface area (i.e., the surface area not masked by masking fixture 82) of the mounted segment to form a pattern seeded segment 20". The patterned seeded segment 20" is then removed from fixture 82 and passed through electrolytic plating station 28 where a thick layer 52 (FIG. 7) of, for example, copper, is electrolytically plated (for example, by barrel plating) to the patterned seed layer.

Figure 6:
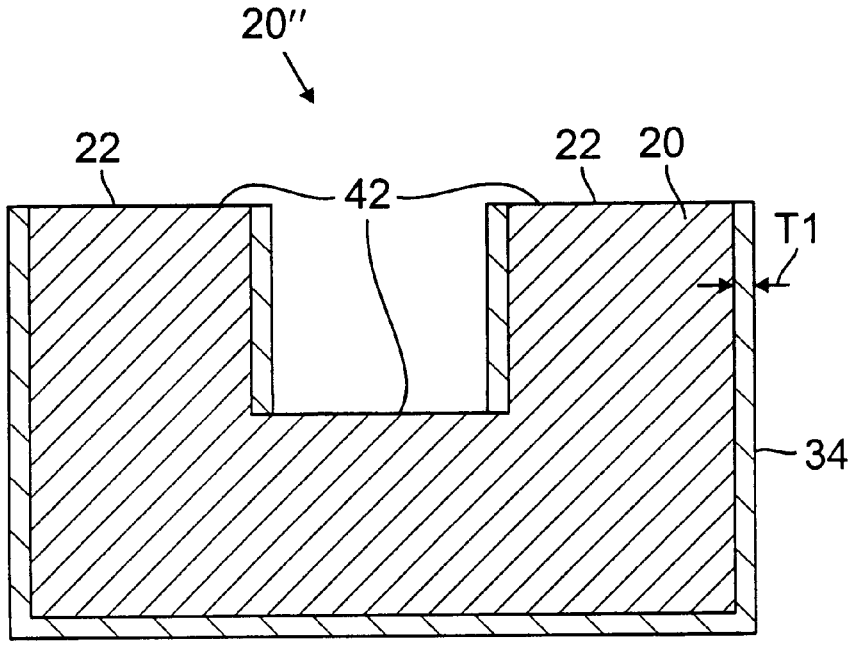
Figure 7:
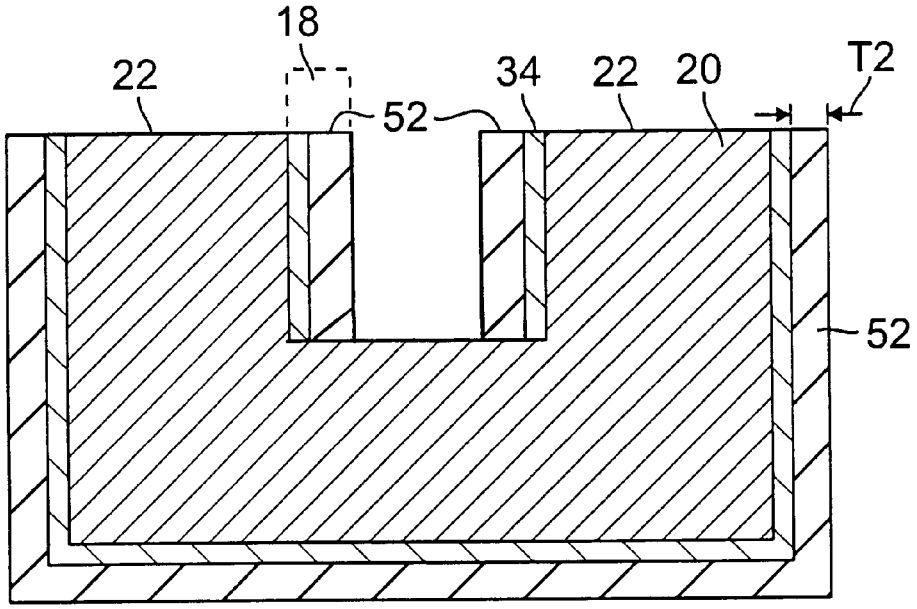

Although masking fixture 82 may be formed from many different materials, preferably masking fixture 82 is injection molded from a thermoplastic elastomer (e.g., HYTREL™, manufactured by Dupont™; KRATON™, manufactured by Shell Oil Company™; SOLPRENE™, manufactured by Phillips Petroleum™), which accommodates the relatively high tolerances of sintered ferrite geometries. A different masking fixture 82 is molded for each different shield 18 pattern 42 (FIG. 6).

One or more segments 20 may be mounted in each masking fixture 82.

Figure 4:
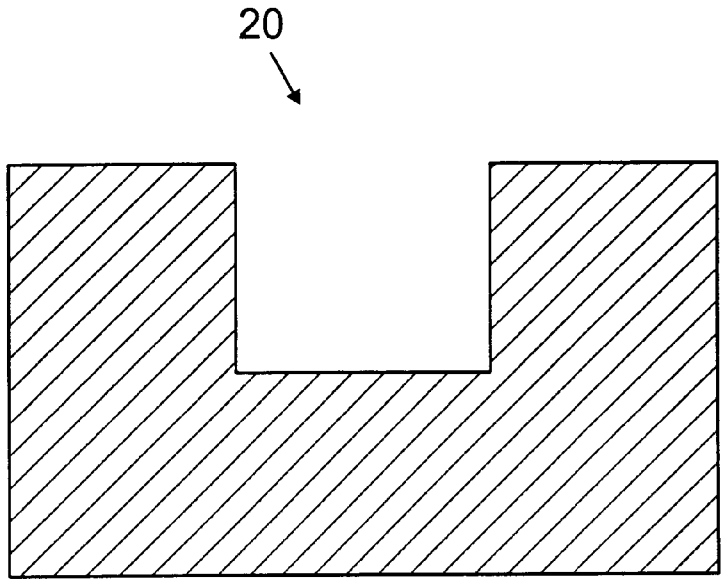
FIGS. 4–7 are cross-sectional side views of a permeable core segment at different stages of manufacture.
Figure 5:
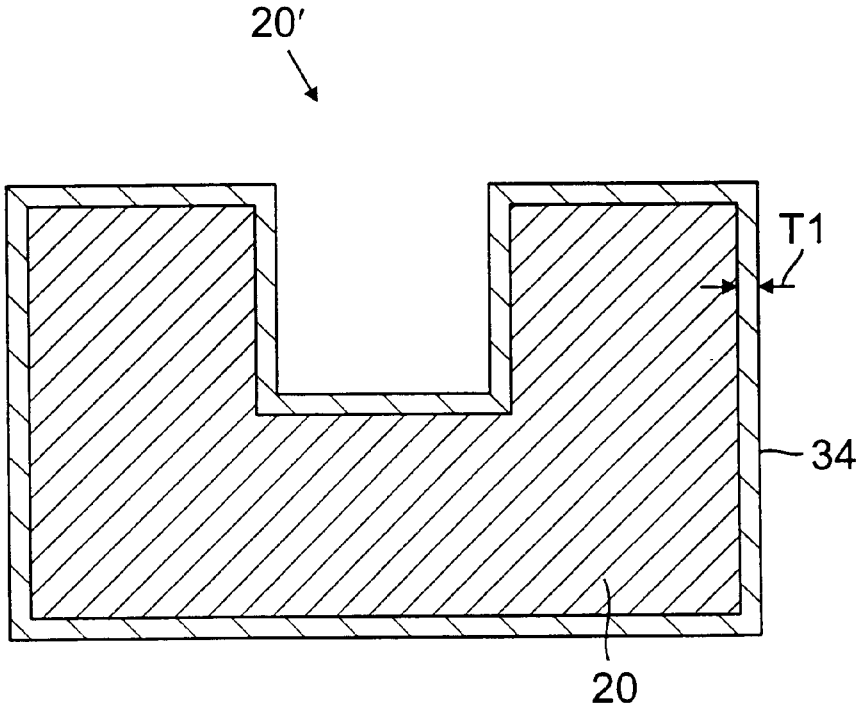
Figure 10:
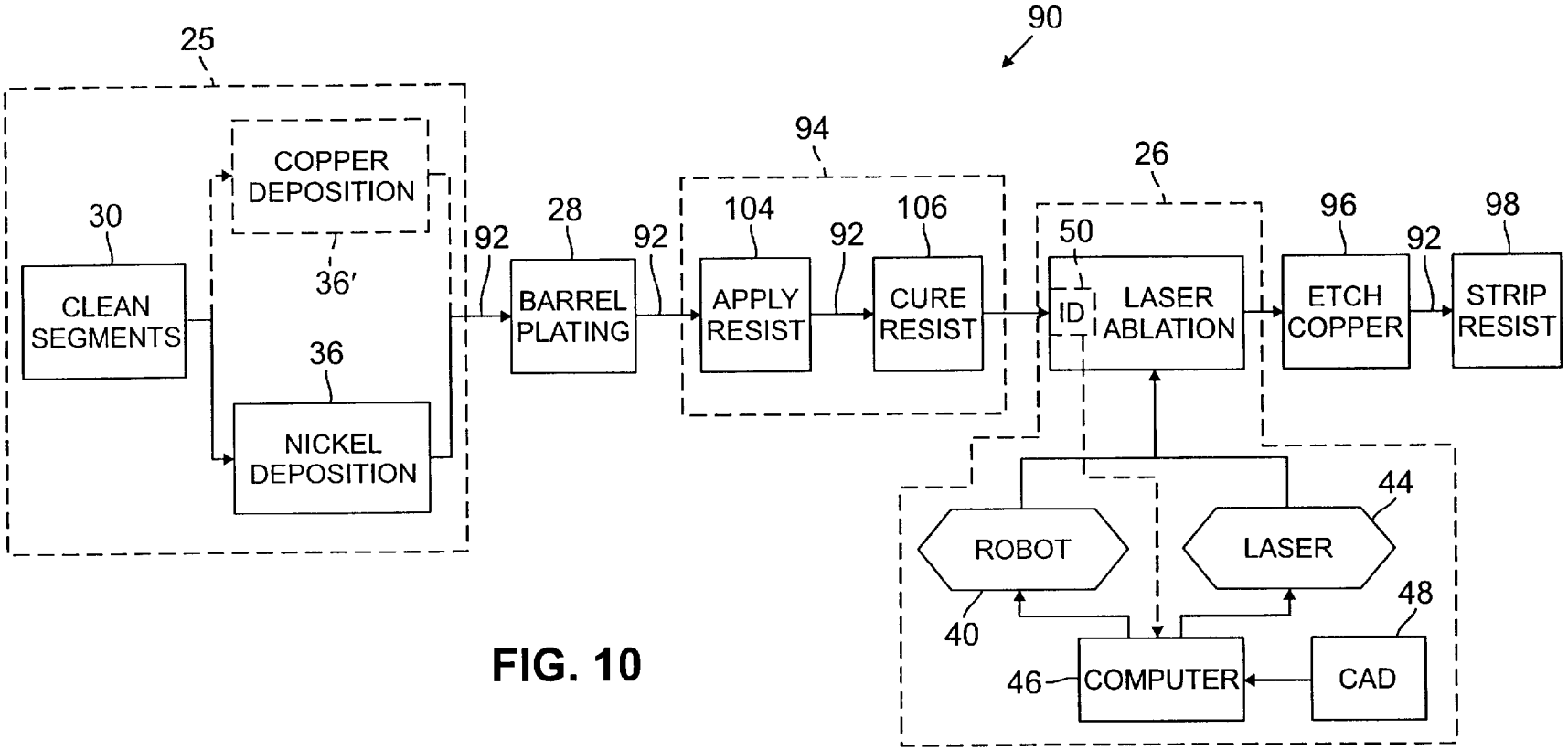
FIG. 10 is a block diagram of an etching manufacturing line.

Referring to FIG. 10, another alternative to laser ablation manufacturing line 23 (FIG. 3) is etching manufacturing line 90 which also plates shields (18, FIG. 2) on a series of permeable core segments (20, FIG. 4). Etching manufacturing line 90 includes an electroless deposition station 25, an electrolytic plating station 28, and a laser patterning station 26 which operate in a manner similar to that described for laser ablation manufacturing line 23. In addition, etching manufacturing line 90 includes a resist station 94, an etching station 96, and a stripping station 98.

Figure 11:
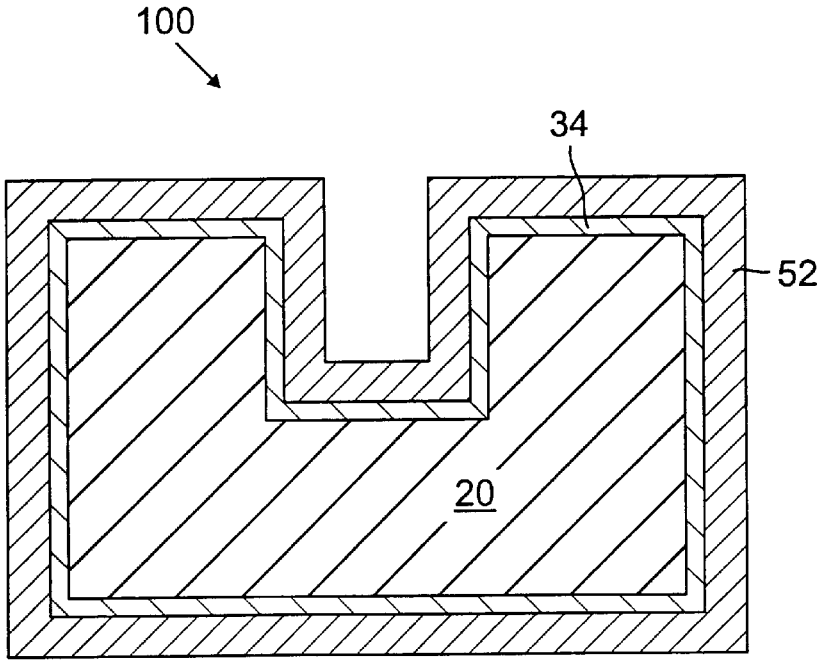
FIGS. 11–14 are cross-sectional side views of a permeable core segment at different stages of manufacture.
Figure 12:
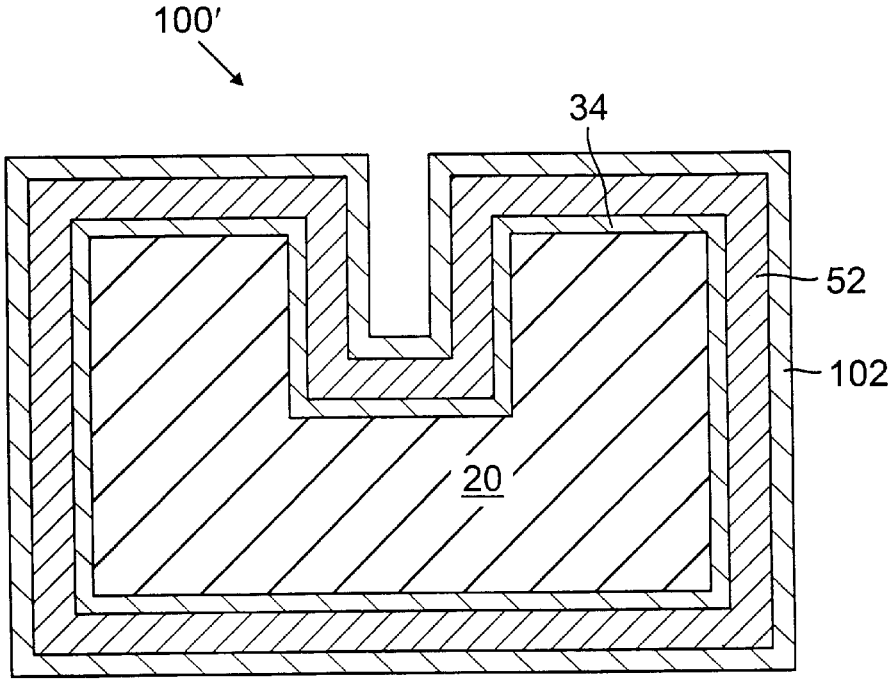

Segment 20 (FIG. 4) is first passed, on a conveyor belt 92, through electroless deposition station 25 in which a seed layer 34 (FIG. 5) of, for example, copper, is deposited on the entire surface area of the segment to form a seeded segment 20'. The seeded segment is then passed through electrolytic plating station 28 to plate a thick layer 52 (FIG. 11) of, for example, copper, on the seed layer to form a fully plated segment 100.

Figure 13:
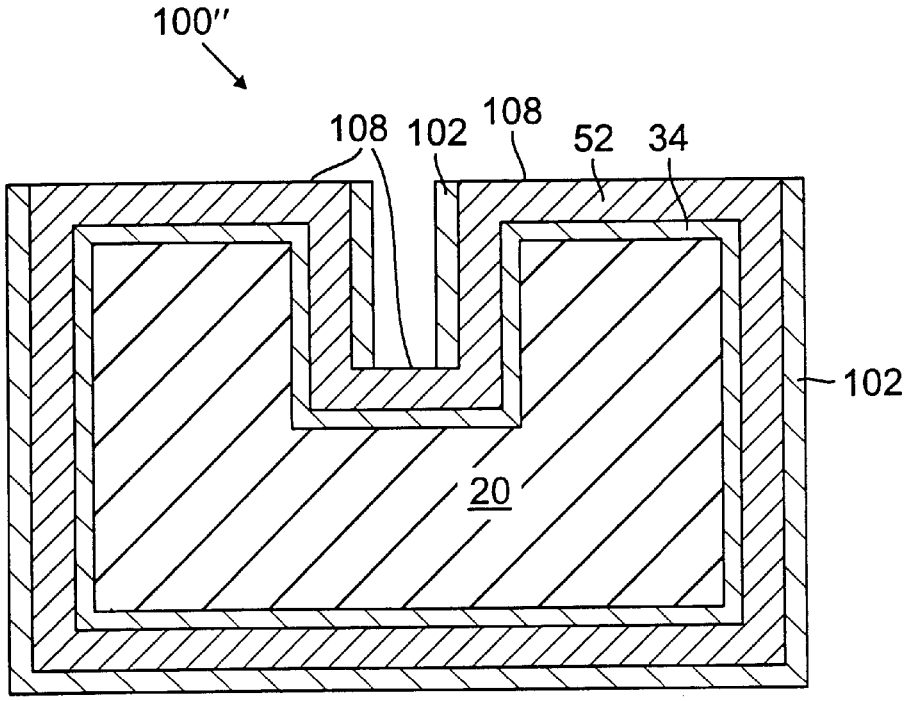

From the electrolytic plating station, the fully plated segment is passed through resist station 94. At a resist applying station 104, a layer 102 of resist, for example, an epoxy based polymer (e.g., KTFR or KPR, manufactured by Eastman Kodak Co.™; AZ PHOTORESIST, manufactured by Shipley Co., Inc.™, Newton, Mass., USA), is applied, for instance, through spraying or dipping, on the entire surface area of the fully plated segment. The resist coated, fully plated segment 100' is then passed through a resist curing station 106 where the resist layer is cured by, for example, applying heat or ultra violet light. Laser patterning station 26 then removes a pattern 108 (FIG. 13) of resist using the techniques described above for removing a pattern 42 (FIG. 6) from seed layer 34.

Figure 14:
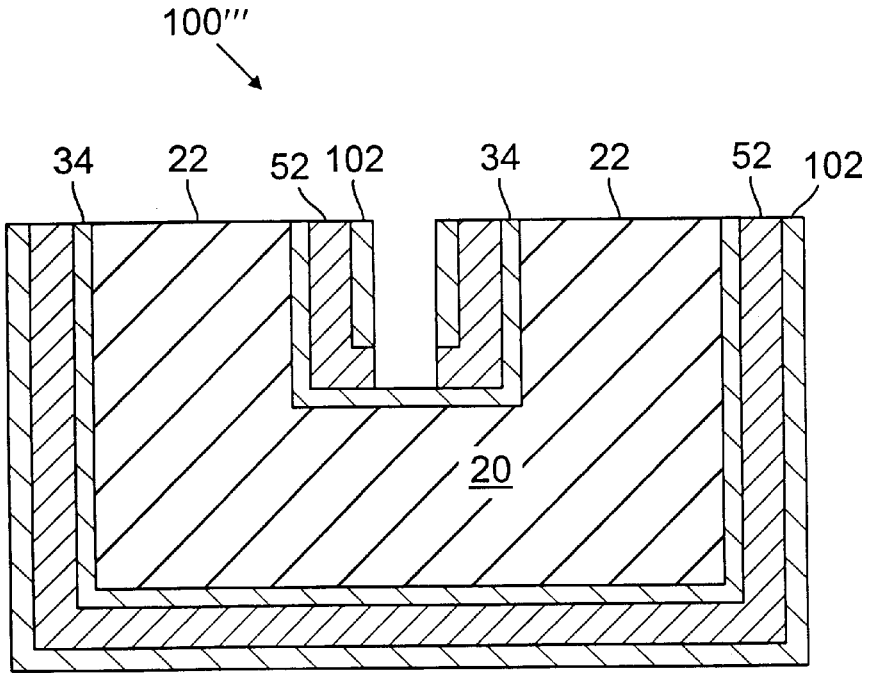

Conveyor belt 92 then carries the patterned resist, fully plated segment 100" (FIG. 13) to etching station 96 where the copper exposed by the removal of resist pattern 108 is chemically etched/removed (FIG. 14) from the surface (including ends 22) of segment 20. Preferably, both seed layer 34 and the thicker electrolytically plated layer 52 are of the same material, for example, copper, such that a single etching station can be used to remove both layers simultaneously. Where seed layer 34 is different from layer 52, separate chemical baths (i.e., separate etching stations) may be required.

The etched segment 100'" is then passed through stripper 98 where the remaining resist layer 102 is removed to provide a permeable core segment 20 with a patterned shield 18 (FIG. 2).

Using laser patterning station 26 (FIG. 3) to remove the seed layer from the permeable core segment 20 may cause localized heating in the surface of the segment that is exposed to the laser beam. Such localized heating may cause the core material, e.g., ferrite, to expand which may cause cracking or exfoliation. Etching manufacturing line 90 uses laser patterning station 26 to remove a pattern 108 within resist layer 102, not a pattern 42 (FIG. 6) within seed layer 34. As a result, laser patterning station 26 of etching manufacturing line 90 does not cause localized heating along a surface of segment 20.

Figure 15:
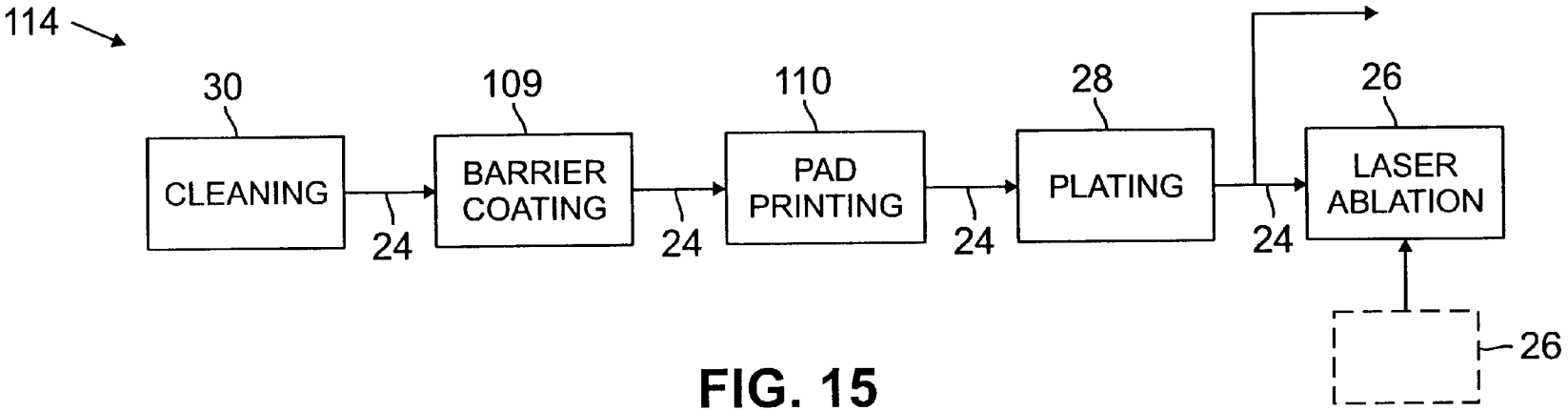
FIG. 15 is a block diagram of a pad-printing manufacturing line.

Referring to FIG. 15, a pad-printing manufacturing line 114 plates a shield on permeable core segment 20 in predetermined patterns by passing the core segments on a conveyor belt 24 through a cleaning station 30, a barrier coating station 109, a pad-printing station 110, a rack or barrel plating station 28, and, in some cases, a laser ablation station 26. Referring also to FIGS. 16–20, permeable core segment 20 of, e.g., ferrite (FIG. 16) is cleaned at a cleaning station 30 by being dipped in a cleaning solvent of 99% isopropyl alcohol. The cleaned core segment 20 is then passed through barrier coating station 109 where a barrier coating 111 (FIG. 17) of, for example, Parylene (available from Paratronix, Attleboro, Mass.) is deposited on the entire surface of core segment 20 using a vacuum coating process. The barrier coating 111 typically is less than 0.001 inch thick, T3, but could range from 0.0002 inch to more than 0.001 inch in thickness.

In pad-printing station 110, a conductive seed layer 34 (FIG. 18) of, for example, silver ink (available from, for example, Creative Materials, Tyngsborough, Mass., USA) is pad-printed on the surface of the barrier coating of segment 112*b* according to a predetermined pattern using, e.g., model TP100 pad-printer available from Teca-Print U.S.A., Billerica, Mass., USA. The pattern of pad-printing on each core depends upon the geometric shape of the permeable core and the desired arrangement of shielding. Multiple interrelated impressions may be required to pad-print the entire predetermined pattern on core segment 20. Seed layer 34 is approximately 0.0002 inch thick, T4. To keep uncontrolled traces of magnetic material away from the core, a silver ink, formulated to be free of magnetic materials, such as iron, cobalt and nickel (available from Creative Materials, Tyngsborough, Mass.) may be used in the pad-printing process.

After coated segment 112*b* has been seeded, the seeded segment 112*c* (FIG. 18) is passed through plating station 28, where a layer 52 of, for example, copper is electrolytically plated to patterned seed layer 34. Plating station 28 may perform rack plating in an acid bath (not shown) that deposits a relatively thick layer T5, e.g., 4–5 mils, of copper on seeded segment 112*c*. As a result, shield 18, comprising barrier coating 111, seed layer 34, and copper layer 52, is plated to permeable core segment 20 in a predetermined pattern. An acid bath gives a higher deposition rate than an alkaline bath. If barrel plating instead of rack plating were used, the barrier coating may be abraded from the edges and ends 22 of the cores during tumbling, thereby causing unwanted plating at the abraded areas. Adjustment of the tumbling speed may, in certain cases, reduce the abrasion.

In some cases, plated segment 112*d* is passed through laser ablation station 26 (described above) where a predetermined pattern 42 (FIG. 20) is ablated by a laser beam to expose ends 22 of segment 20, resulting in ablated segment 112*e*.

Pairs of plated segments 112*d* or ablated segments 112*e* may be mated to form permeable core 16 (FIG. 2).

Figure 21:
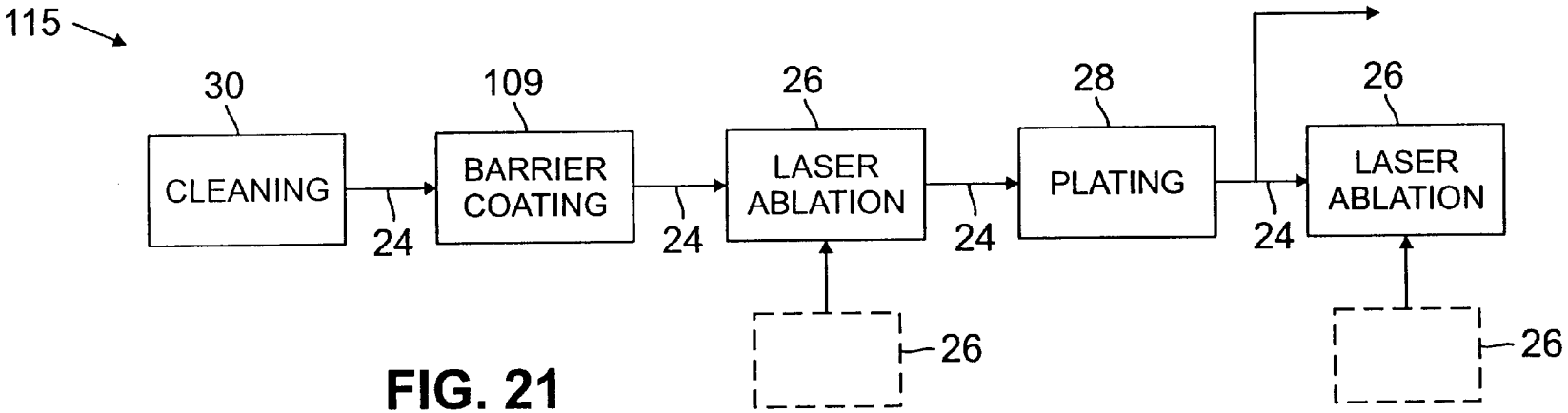
FIG. 21 is a block diagram of another laser ablation manufacturing line.
Figure 16:
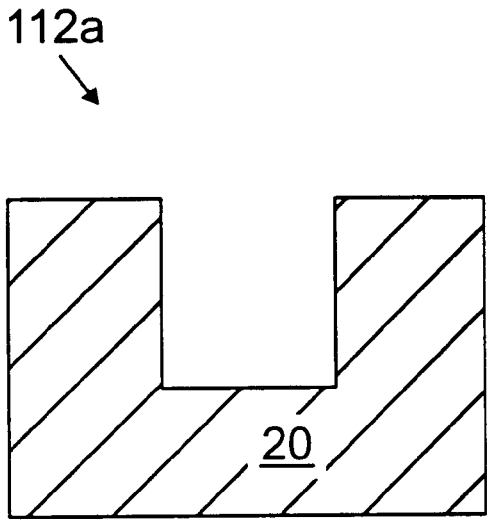
FIGS. 16–20 are cross-sectional side views of a permeable core segment at different stages of manufacture.
Figure 17:
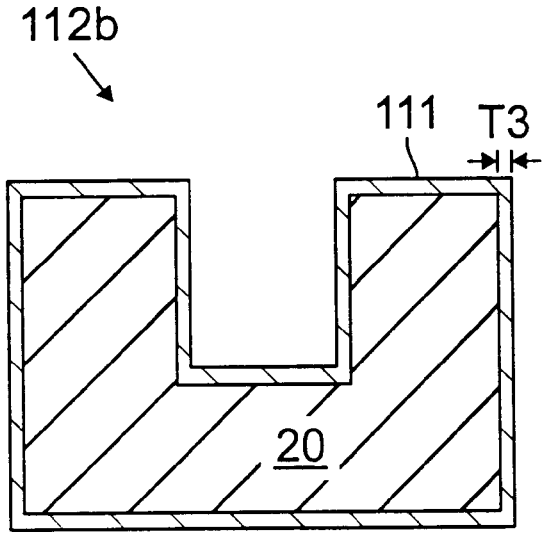
Figure 18:
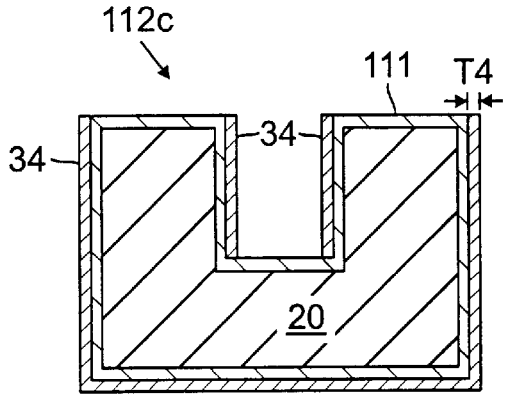
Figure 19:
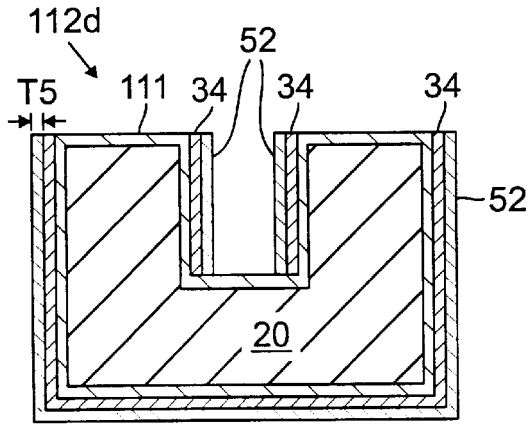
Figure 20:
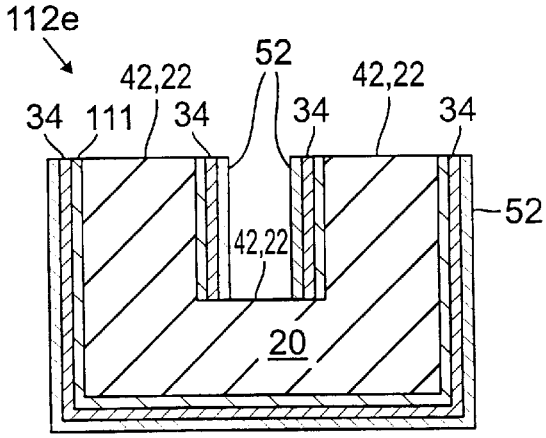
Figure 22:
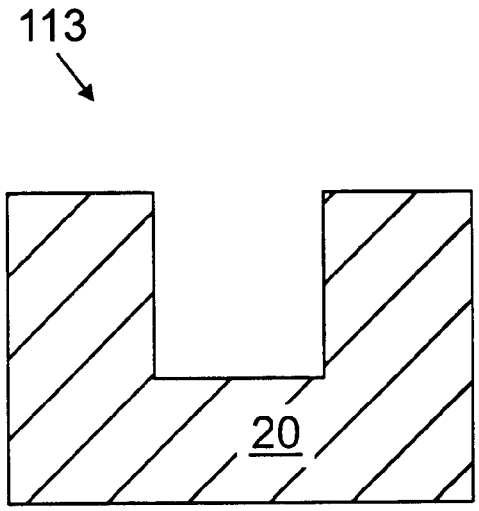
FIGS. 22–26 are cross-sectional side views of a permeable core segment at different stages of manufacture.
Figure 23:
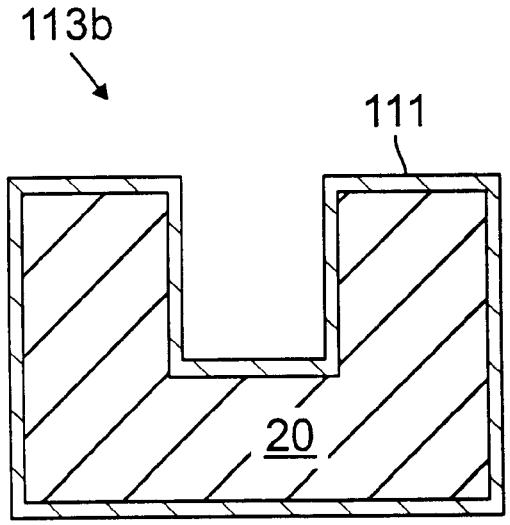
Figure 24:
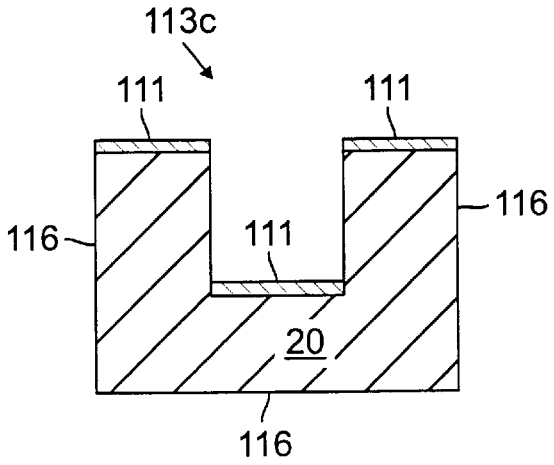
Figure 25:
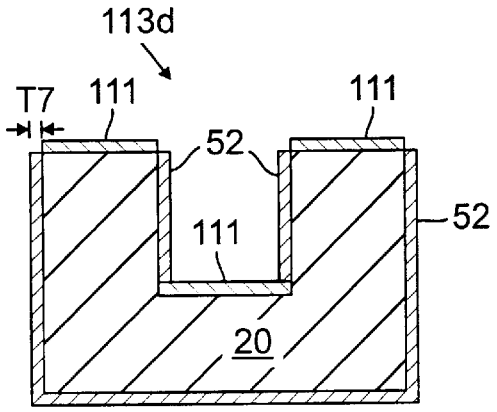
Figure 26:
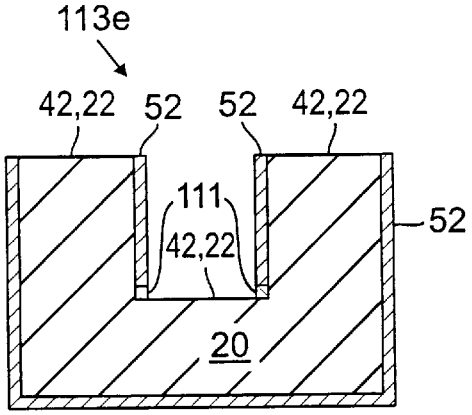
Figure 27:
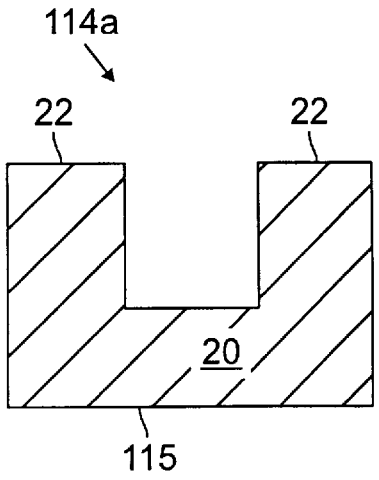
FIGS. 27–31 are cross-sectional side views of a permeable core segment at different stages of manufacture.

Referring to FIG. 21, in a laser ablation manufacturing line 115, after passing through cleaning station 30 and applying a barrier coating 111, segment 113*b* is then passed through laser ablation station 26 (described above) where a predetermined pattern 116 (FIG. 24) is ablated by a laser beam, resulting in pattern coated segment 113*c*. After ablating part of the barrier coating, a layer 52 of, for example, copper is deposited on the uncoated portions of segment 113*c* (FIG. 25) by passing it through an electrolytic plating station 28. Plating station 28 may include rack or barrel plating in an alkaline bath (not shown) that deposits a relatively thick layer T7, e.g., 4–5 mils, of copper on segment 113*c*, resulting in plated segment 113*d*. An alkaline bath is preferable to an acid bath for plating copper directly onto the surface of a ferrite core because acid tends to react with the exposed portions of the core 116 (i.e., where the barrier coating has been ablated), resulting in a change in the magnetic characteristics of the core. For example, when ferrites containing zinc or zinc compounds are exposed to acid plating baths, there is a measurable degradation in the magnetic and core loss characteristics of the ferrite material.

In some cases, plated segment 113*d* is passed through laser ablation station 26, as described above, to expose ends 22 of segment 20. Alternatively, the ends may be exposed by grinding or air abrasion.

Figure 28:
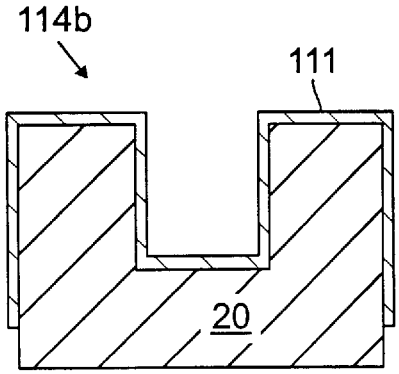
Figure 29:
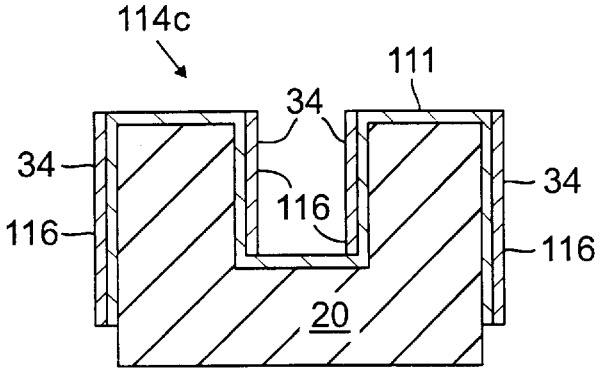
Figure 30:
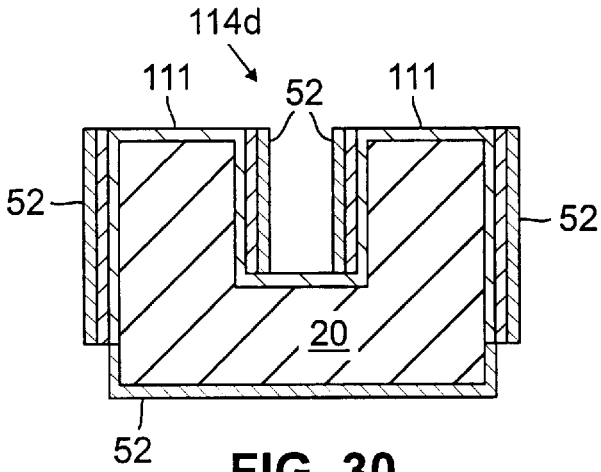
Figure 31:
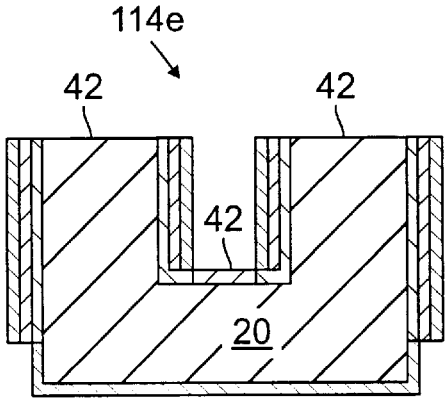
Figure 32:
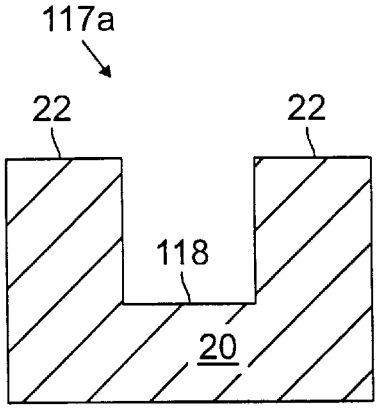
FIGS. 32–35 are cross-sectional side views of a permeable core segment at different stages of manufacture.

Referring to FIGS. 27–31, in another manufacturing line (similar to 114, FIG. 15), after passing through cleaning station 30, core segment 20 (FIG. 27) is partially coated with a barrier coating 111 by either dipping a portion of the core in the barrier bath or pad-printing the barrier coating, such that the large end 115 of the core is left uncovered with the barrier coating (FIG. 28).

Coated segment 114*b* is then passed through pad-printing station 110, where a conductive seed layer 34 is pad-printed on the core in a predetermined pattern 116 (FIG. 29), depending upon the geometric configuration of core segment 20. Seeded segment 114*c* (FIG. 29) is then passed through barrel or rack plating station 28 where a layer 52 of copper is deposited on both the seeded portions of the core as well as the portions of the core that are not covered with a barrier coating (e.g., 115) using an alkaline bath.

Plated segment 114*d* (FIG. 30) may then be passed through laser ablation station 26, as described above.

Figure 33:
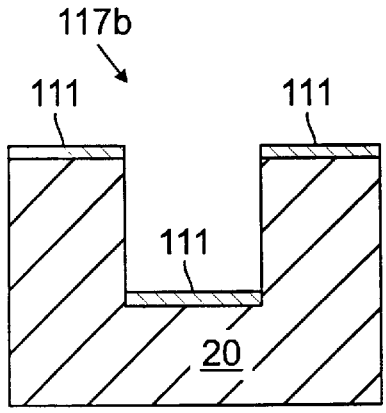
Figure 34:
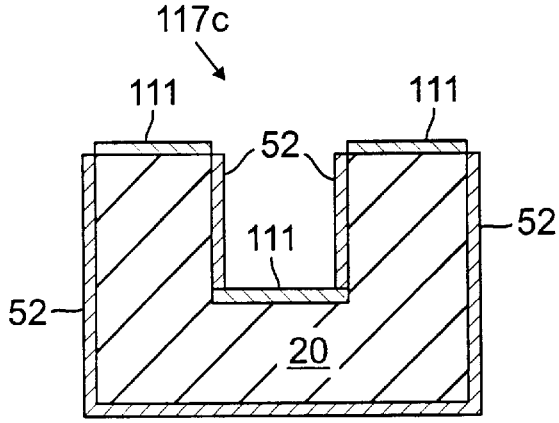
Figure 35:
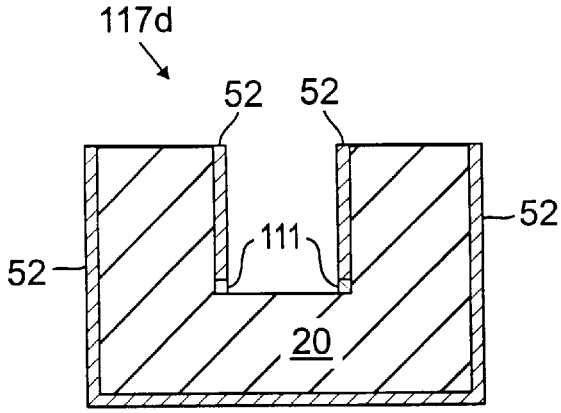

Referring to FIGS. 32–35, in another manufacturing line (similar to 115, FIG. 21), after passing through cleaning station 30, core segment 20 (FIG. 32) is pad-printed with a barrier coating 111 on the ends 22 and in the interior section 118 between the legs (FIG. 33). Instead of seed coating the core, a layer 52 of, for example, copper is barrel plated 28 onto the exposed portions of segment 117*b* using an alkaline bath. Resulting segment 117*c* may then be laser ablated 26 to expose ends 22. (FIG. 35).

Figure 36:
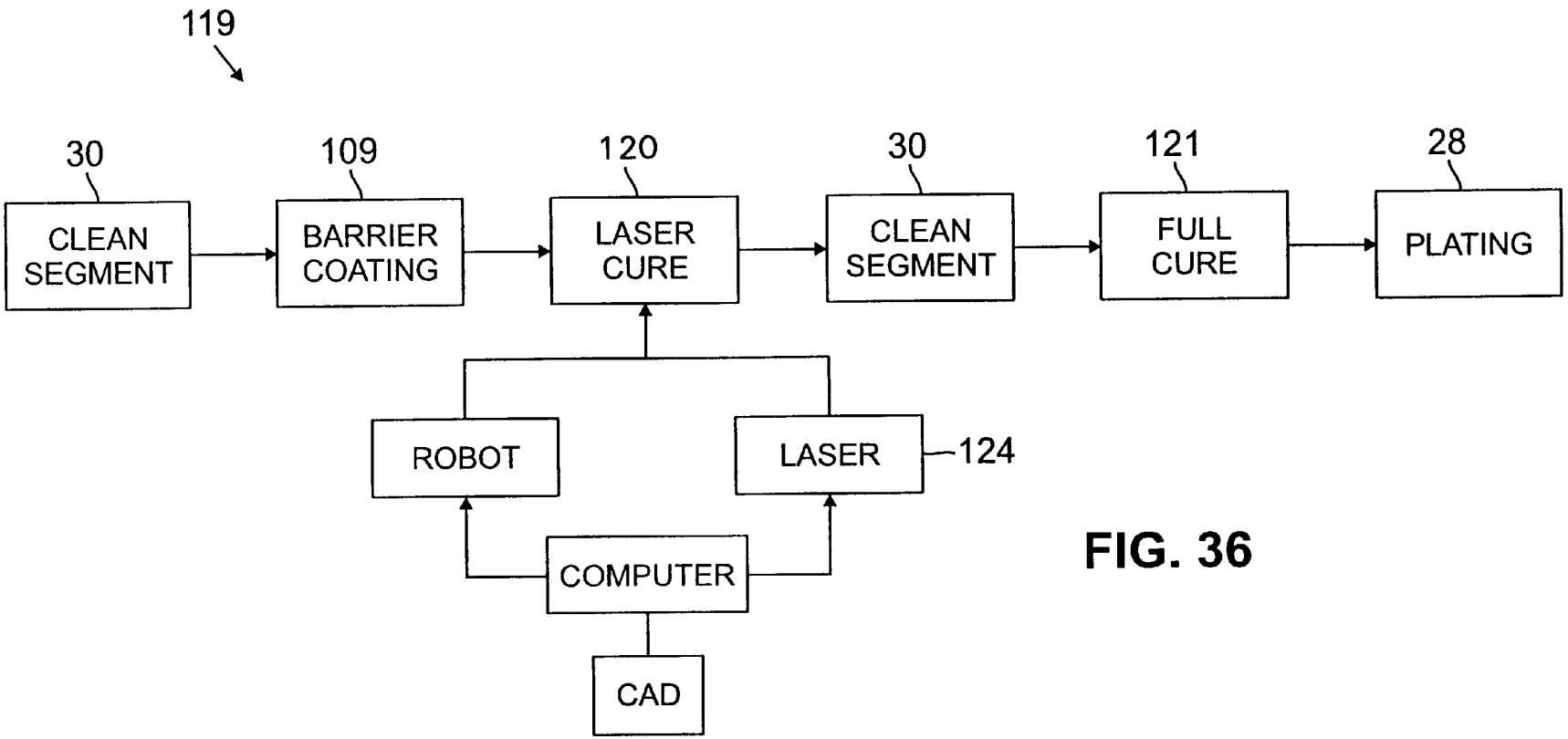
FIG. 36 is a block diagram of a laser curing manufacturing line.
Figure 37:
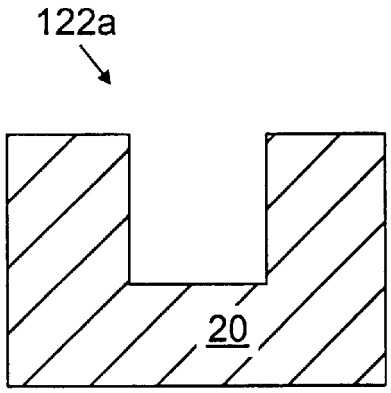
FIGS. 37–42 are cross-sectional side views of a permeable core segment at different stages of manufacture.

Referring to FIG. 36, a laser curing manufacturing line 119 plates shield 18 (FIG. 2) on permeable core segments 20*a*, 20*b* (FIG. 2) in predetermined patterns by passing the core segments through a cleaning station 30, a barrier coating station 109, a laser curing station 120, a second cleaning station 30, an oven curing station 121, and a plating station 28.

Figure 38:
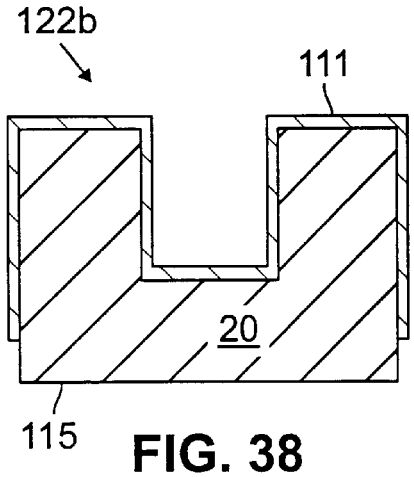
Figure 39:
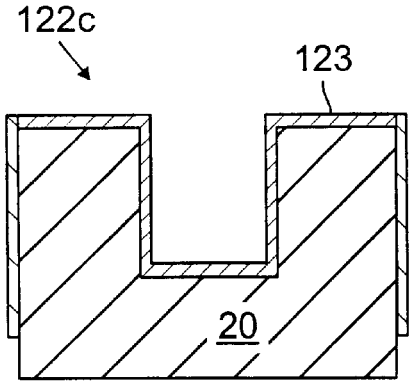
Figure 40:
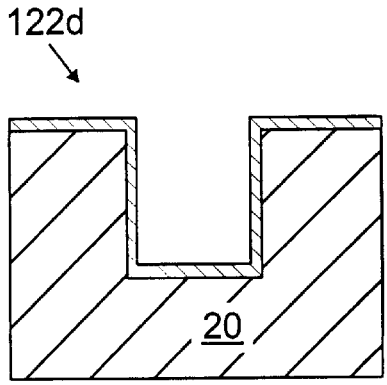
Figure 41:
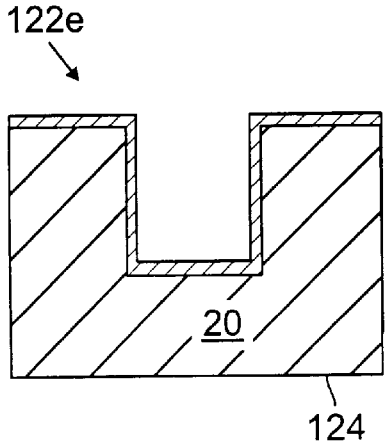
Figure 42:
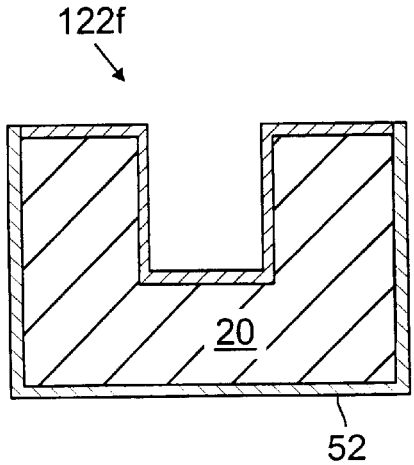

Referring also to FIGS. 37–42, after passing through cleaning station 30, core segment 20 (FIG. 37) is partially coated with a barrier coating 111 by dipping a portion of the core in a bath of photodefinable epoxy, such as CIBATOOL SL 5170 (available from 3D Systems, Valencia, Calif.). The large end 115 of core segment 20 is left uncovered with the barrier coating 111, as shown in FIG. 38.

Coated segment 122*b* is then passed through laser curing station 120 where a low-power ultraviolet (UV) laser 124 (HeCd laser available from Omnichrome, Chino, Calif.) cures a predetermined pattern 123 (FIG. 39) of epoxy on the surface of core segment 20. The liquid epoxy solidifies when the laser beam (not shown) comes in contact with it. Laser-cured segment 122*c* is then cleaned a second time in cleaning station 30, where any uncured epoxy is washed off core segment 20. Before plating the core, the epoxy is fully cured by passing it through oven curing station 121, where a UV oven (not shown) further hardens the epoxy and drives off any remaining moisture. Typically, full curing requires approximately twenty minutes in the UV oven.

Finally, in plating station 28 a layer 52 of, for example, copper is deposited on the uncoated portions of segment 122*e* (FIG. 41) by barrel plating the core in an alkaline bath (not shown). Barrel plating deposits a relatively thick layer, e.g., 4–5 mils, of copper on segment 122*e*, resulting in plated segment 122*f*. An alkaline bath is preferable to an acid bath for plating copper directly onto the surface of a ferrite core because acid tends to react with the exposed portions of the core 124 (i.e., where there is no epoxy), resulting in a change in the magnetic characteristics of the core.

What is claimed is:

1. A method comprising:

providing a magnetically permeable core to be plated with a conductive shield;

generating, interactively by computer, pattern data defining a selected pattern for the shield, and plating the conductive shield to the magnetically permeable core by:

patterning a seed layer on the magnetically permeable core to leave the selected pattern covering less than the entire surface of the core, and plating an outer layer on the seed layer.

2. The method of claim 1, wherein the patterning comprises:

removing a portion of the seed layer.

3. The method of claim 1, further comprising:

electrolessly depositing the seed layer on the permeable core.

4. The method of claim 1, wherein the patterning further comprises:

ablating a portion of the seed layer with a laser.

5. The method of claim 1, further comprising:

transferring the pattern data from a computer aided design station to a computer that controls the patterning of the seed layer.

6. The method of claim 1, further comprising:

identifying a geometric configuration of the permeable core, and wherein the patterning is in accordance with the identified geometric configuration.

7. The method of claim 1, wherein the patterning further comprises:

depositing the seed layer on the permeable core in the selected pattern defined by a mask.

8. The method of claim 7, further comprising:

identifying a geometric configuration of the permeable core; and selecting the mask from a supply of masks in accordance with the geometric configuration of the permeable core.

9. The method of claim 1, wherein the permeable core comprises a permeable core segment.

10. The method of claim 9, further comprising, after plating:

attaching an end of the permeable core segment to an end of another permeable core segment to form a permeable core.

11. The method of claim 1, further comprising:

adding windings to the plated permeable core.

12. The method of claim 1, further comprising:

connecting the plated permeable core to a power converter circuit.

13. A method comprising:

providing a magnetically permeable core to be plated with a conductive shield;

plating the conductive shield to the magnetically permeable core by:

depositing a seed layer on the permeable core;

removing, using a machine-automated apparatus, a portion of the seed layer; and plating an outer layer on the seed layer.

14. The method of claim 13 further comprising:

covering the permeable core with a barrier coating before depositing the seed layer to protect a magnetic property of the core from alteration by the plating process.

15. The method of claim 14 in which the barrier coating comprises a photodefinable epoxy.

16. A method comprising:

generating, interactively by computer, pattern data defining a selected pattern for a conductive shield to be plated on a magnetically permeable core and configured to achieve a controlled leakage inductance, plating the conductive shield to the magnetically permeable core by:

depositing a seed layer on a surface of the permeable core;

plating an outer layer on the seed layer; and patterning the seed and outer layers in the pattern configured to achieve the controlled leakage inductance.

17. The method of claim 16, wherein patterning includes:

forming a pattern in a layer of resist on the outer layer; and etching a portion of the outer layer and a portion of the seed layer in accordance with the resist pattern.

18. The method of claim 17, wherein forming includes:

ablating a portion of the resist layer with a laser beam.

19. The method of claim 17, further comprising:

identifying a geometric configuration of the permeable core, wherein forming is in accordance with the identified geometric configuration of the permeable core.

20. The method of claim 16, wherein the permeable core is a permeable core segment.

21. The method of claim 20, further comprising, after plating:

attaching an end of the permeable core segment to an end of another permeable core segment to form a permeable core.

22. The method of claim 16, further comprising:

adding windings to the plated permeable core.

23. The method of claim 16, further comprising:

connecting the plated permeable core to a power converter circuit.

24. A method of patterning conductive shields on magnetically permeable cores moving along an automated production line, comprising:

for each of the magnetically permeable cores:

determining a conductive shield pattern to be plated on the permeable core; and plating the determined conductive shield pattern on the permeable core.

25. The method of claim 24 wherein the plating further comprises:

depositing a seed layer on the permeable core;

plating an outer layer on the seed layer;

ablating a resist layer on the outer layer with a laser beam to form a resist pattern on the outer layer; and etching the outer layer and the seed layer in accordance with the resist pattern.

26. The method of claim 24, wherein plating includes:

depositing a seed layer on the permeable core;

removing a portion of the seed layer in accordance with the determined shield pattern; and plating an outer layer on the seed layer.

27. The method of claim 24, wherein plating includes:

selecting a mask from a supply of masks in accordance with the determined shield pattern;

depositing a seed layer on the permeable core in accordance with the determined shield pattern defined by the mask; and plating an outer layer on the seed layer.

28. The method of claim 24, wherein the permeable cores are identical.

29. The method of claim 25 further comprising:

covering the permeable core with a barrier coating before plating the shield to protect a magnetic property of the core from alteration by the plating process.

30. The method of claim 29 in which the barrier coating comprises a photodefinable epoxy.

31. A method of patterning conductive shields on magnetically permeable cores moving along an automated production line, comprising:

for each of the magnetically permeable cores:

determining a conductive shield pattern for the permeable core; and patterning a plated conductive shield in accordance with the determined shield pattern to achieve a controlled leakage inductance.

32. The method of claim 31, wherein patterning includes:

forming a layer of resist on the plated shield in accordance with the determined shield pattern; and etching the plated shield in accordance with the determined shield pattern defined by the resist layer.

33. The method of claim 31, further comprising:

plating the shield on the permeable core.

34. The method of claim 31, wherein the permeable cores are identical.

35. The method of claim 31 further comprising:

plating the conductive shield to the core, and covering the permeable core with a barrier coating before patterning the shield to protect a magnetic property of the core from alteration by the plating process.

36. The method of claim 35 in which the barrier coating comprises a photodefinable epoxy.

37. The method of claim 1, 13, 16, 24 or 31 wherein the plating comprises rack plating.

38. The method of claim 1, 13, 16, 24 or 31 wherein the plating comprises barrel plating.

* * * * *

UNITED STATES PATENT AND TRADEMARK OFFICE

CERTIFICATE OF CORRECTION

PATENT NO. : 6,165,340
DATED : December 26, 2000
INVENTOR(S) : Craig R. Davidson et al.

It is certified that error appears in the above-identified patent and that said Letters Patent is hereby corrected as shown below:

Column 1,
Line 40, change “a-permeable” to -- a permeable --.

Column 5,
Line 33, change “se pent” to -- segment --.
Line 37, change “V-E2” to -- RV-E2 --.

Column 12,
Line 38, change “method of claim 25” to -- method of claim 24 --.

Signed and Sealed this

Eighth Day of April, 2003

JAMES E. ROGAN
*Director of the United States Patent and Trademark Office*